US010927567B2

(12) United States Patent
Albertson et al.

(10) Patent No.: US 10,927,567 B2
(45) Date of Patent: Feb. 23, 2021

(54) LOCK BYPASS DETECTION

(71) Applicant: International Business Machines Corporation, Armonk, NY (US)

(72) Inventors: Chad M. Albertson, Rochester, MN (US); Eric J. Campbell, Rochester, MN (US); Nicholas J. Ollerich, Rochester, MN (US); Christopher W. Steffen, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/237,694

(22) Filed: Jan. 1, 2019

(65) Prior Publication Data

US 2019/0136579 A1 May 9, 2019

Related U.S. Application Data

(63) Continuation of application No. 15/414,839, filed on Jan. 25, 2017, now Pat. No. 10,167,655.

(51) Int. Cl.

| | |
|---|---|
| ***E05B 45/08*** | (2006.01) |
| ***E05B 27/00*** | (2006.01) |
| ***E05B 45/10*** | (2006.01) |

(52) U.S. Cl.

CPC ..... *E05B 45/08* (2013.01); *E05B 27/0017* (2013.01); *E05B 27/0057* (2013.01); *E05B 45/10* (2013.01)

(58) Field of Classification Search

CPC ..... E05B 45/08; E05B 45/10; E05B 27/0017; E05B 27/0057; E05B 27/05; E05B 49/00; E05B 2047/0086; E05B 2047/0058; E05B 2047/002; E05B 2047/0067;

(Continued)

(56) References Cited

U.S. PATENT DOCUMENTS

| | | | |
|---|---|---|---|
| 1,172,203 | A | 2/1916 | Fuller |
| 2,059,129 | A | 10/1936 | Maxwell et al. |
| 2,095,819 | A | 10/1937 | Lefebvre |

(Continued)

FOREIGN PATENT DOCUMENTS

| | | | |
|---|---|---|---|
| CN | 201169985 | Y | 12/2008 |
| CN | 203348708 | U | 12/2013 |

(Continued)

OTHER PUBLICATIONS

"Chubb detector lock," Wikipedia, the free encyclopedia, (printed: Oct. 10, 2016, last updated: Aug. 3, 2016), 2 pages, https://en.wikipedia.org/w/index.php?title=Chubb_detector_lock&printable=yes.

(Continued)

*Primary Examiner* — Suzanne L Barrett
(74) *Attorney, Agent, or Firm* — Nathan M. Rau

(57) ABSTRACT

A lock system and method for alerting a user or other entity that a lock has been or is being tampered with is disclosed. The lock includes at least one enhanced security pin that is electrically isolated from the rest of the lock. When the lock picker attempts to pick the lock a portion of the enhanced security pin contacts either the plug or the outer casing of the lock to complete a circuit with an alert component. The completion of the circuit causes the alert component to generate an alert signal that can be observed by the user or other entity.

12 Claims, 7 Drawing Sheets

(58) Field of Classification Search
CPC ..... E05B 47/0001; E05B 47/0012; E05B 47/026; E05B 47/02; E05B 47/00; E05B 47/0004
USPC ..... 70/277, 276, 493, 378, 416, 419, 421, 70/431–434; 200/61.66
See application file for complete search history.

(56) References Cited

U.S. PATENT DOCUMENTS

| | | | | |
|---|---|---|---|---|
| 3,416,336 | A | 12/1968 | Felson | |
| 3,494,157 | A | 2/1970 | Coker, Jr. | |
| 3,512,382 | A | 5/1970 | Check et al. | |
| 3,518,855 | A | 7/1970 | Wake | |
| 3,654,782 | A | 4/1972 | Heimann | |
| 3,656,328 | A | 4/1972 | Hughes | |
| 3,660,999 | A | 5/1972 | Janzen | |
| 3,665,740 | A | 5/1972 | Taniyama | |
| 3,764,859 | A | 10/1973 | Wood et al. | |
| 3,967,481 | A | 7/1976 | Schlage | |
| 4,026,134 | A | 5/1977 | Woolfson | |
| 4,186,578 | A | 2/1980 | Sommer | |
| 4,328,691 | A | 5/1982 | Scherbing | |
| 4,377,940 | A * | 3/1983 | Hucknall | E05B 15/1614 70/378 |
| 4,380,162 | A | 4/1983 | Woolfson | |
| 4,403,486 | A | 9/1983 | Miyake | |
| 4,656,851 | A | 4/1987 | Leek et al. | |
| 5,074,136 | A | 12/1991 | Kim et al. | |
| 5,697,239 | A * | 12/1997 | Hanneman | E05B 17/0004 225/2 |
| 6,367,297 | B1 | 4/2002 | Mottura | |
| 6,441,735 | B1 | 8/2002 | Marko et al. | |
| 6,481,254 | B1 | 11/2002 | Zheng et al. | |
| 7,272,965 | B2 | 9/2007 | Dolev | |
| 7,421,870 | B1 | 9/2008 | Wu et al. | |
| 7,958,647 | B2 | 6/2011 | Gerner | |
| 8,312,749 | B2 | 11/2012 | Tong | |
| 9,567,770 | B1 | 2/2017 | Ginos et al. | |
| 10,030,416 | B1 * | 7/2018 | Albertson | E05B 27/0057 |
| 10,167,655 | B2 * | 1/2019 | Albertson | E05B 27/0057 |
| 2003/0140668 | A1 | 7/2003 | Chao | |
| 2005/0022568 | A1 | 2/2005 | Dolev | |
| 2005/0186027 | A1 | 8/2005 | Kang | |
| 2005/0275535 | A1 | 12/2005 | Hsieh | |
| 2008/0127694 | A1 | 6/2008 | Wong et al. | |
| 2009/0173121 | A1 | 7/2009 | Cheng et al. | |
| 2009/0178451 | A1 | 7/2009 | Wu et al. | |
| 2010/0050715 | A1 | 3/2010 | Hu et al. | |
| 2010/0139340 | A1 | 6/2010 | Gerner | |
| 2012/0192603 | A1 | 8/2012 | Liu | |
| 2012/0210756 | A1 * | 8/2012 | Mah | E05B 67/22 70/49 |
| 2013/0061643 | A1 | 3/2013 | Chen | |
| 2016/0017636 | A1 | 1/2016 | Charnley et al. | |

FOREIGN PATENT DOCUMENTS

| | | | |
|---|---|---|---|
| CN | 205189531 | U | 4/2016 |
| DE | 3912760 | A1 | 10/1990 |
| EP | 2345783 | A1 | 7/2011 |
| JP | 4711799 | B2 | 6/2011 |

OTHER PUBLICATIONS

Anonymous, "Method and Apparatus for Physical Lock Security Enhancement Via Magnetorheological Fluid Collaboration," IP.com Prior Art Database Technical Disclosure, IP.com No. IPCOM000220600D, Aug. 8, 2012, pp. 1-5, http://ip.com/IPCOM/000220600.

Albertson et al., "Enhanced Locking Mechanism," U.S. Appl. No. 15/414,876, filed Jan. 25, 2017.

Albertson et al., "Lock Bypass Detection," U.S. Appl. No. 15/414,839, filed Jan. 25, 2017.

Albertson et al., "Lock Bypass Detection," U.S. Appl. No. 15/685,934, filed Aug. 24, 2017.

List of IBM Patents or Patent Applications Treated as Related, signed Jan. 3, 2019, 2 pages.

* cited by examiner

LOCK BYPASS DETECTION

BACKGROUND

The present disclosure relates to keys and locks, and more specifically, to locks that can detect when they are being tampered with.

Keys and locks have been around for years. They are often used in combination with each other to secure property. To unlock the lock, the key is inserted into the lock and then turned. This causes a cam or lever on the end of the lock to rotate from a locked to an unlocked position and allowing access to the area or space which the lock was protecting. The lock will open if the correct key is inserted. If an incorrect key is inserted the lock will not open as the key cannot be turned. However, locks are often the targets of lock pickers. Lock pickers use a number of tools or picks to push the pins in the lock to the correct position to permit the plug in the lock to rotate. There have been numerous attempts to make locks that are more difficult or impossible to pick. However, each of these approaches to making a more secure lock give evidence to the picker of their enhanced capabilities. For example, magnetic locks require keys that have magnets on them which are obvious to the casual observer. Thus, tipping the lock picker to what tools and what approaches are needed to pick the particular lock. Further, a lock picker is often able to return to a lock on many different times in an attempt to pick the lock. They may do this over a period of time to avoid being detected.

SUMMARY

Disclosed herein is a lock system for alerting a user or other entity that a lock has been or is being tampered with. The lock includes at least one enhanced security pin that is electrically isolated from the rest of the lock. When the lock picker attempts to pick the lock a portion of the enhanced security pin contacts either the plug or the outer casing of the lock to complete a circuit with an alert component. The completion of the circuit causes the alert component to generate an alert signal that can be observed by the user or other entity.

According to embodiments of the present disclosure a lock comprising a plug and an outer casing is disclosed. The plug has a keyway and a first plurality of shafts. The outer casing has a plug hole disposed in a center portion of the outer casing. The plug hole is shaped to accept the plug into the outer casing. The outer casing further includes a second plurality of shafts. A plurality of springs is disposed within the second plurality of shafts, each of the second plurality of shafts has a single spring. A plurality of driver pins are connected to a corresponding one of the plurality of springs. A plurality of key pins are connected to a corresponding one of the plurality of driver pins. At least one of the driver pins is an enhanced security pin. The enhanced security pin has a top portion and a bottom portion comprised of a non-conductive material and a center portion comprised of an electrically conductive material. A wire is disposed in the center portion of the security pin and a second wire is disposed in either the plug or the outer casing. An alert component is connected to both of the wires such that when the center portion contacts a portion of either the plug or the outer casing an electrical circuit is completed between the first wire, the second wire and the alert component causing the alert component to generate an alert signal.

According to embodiments of the present disclosure a method of detecting an attempted tampering with a lock is disclosed. The method begins by inserting a tool other than a key into a keyway of the lock. Next a plurality of key pins and a plurality of driver pins within the lock are displaced by the tool. At least one of the plurality of driver pins is an enhanced security pin. Next the plug of the lock is rotated, however, full rotation of the plug is prevented by the enhanced security pin contacting a portion of the plug or a portion of an outer casing of the lock. This occurs because the enhanced security pin does not align with the shear line. This completes a circuit between the enhanced security pin and an alert component. As a result of the completed circuit the alert component generates an alert.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
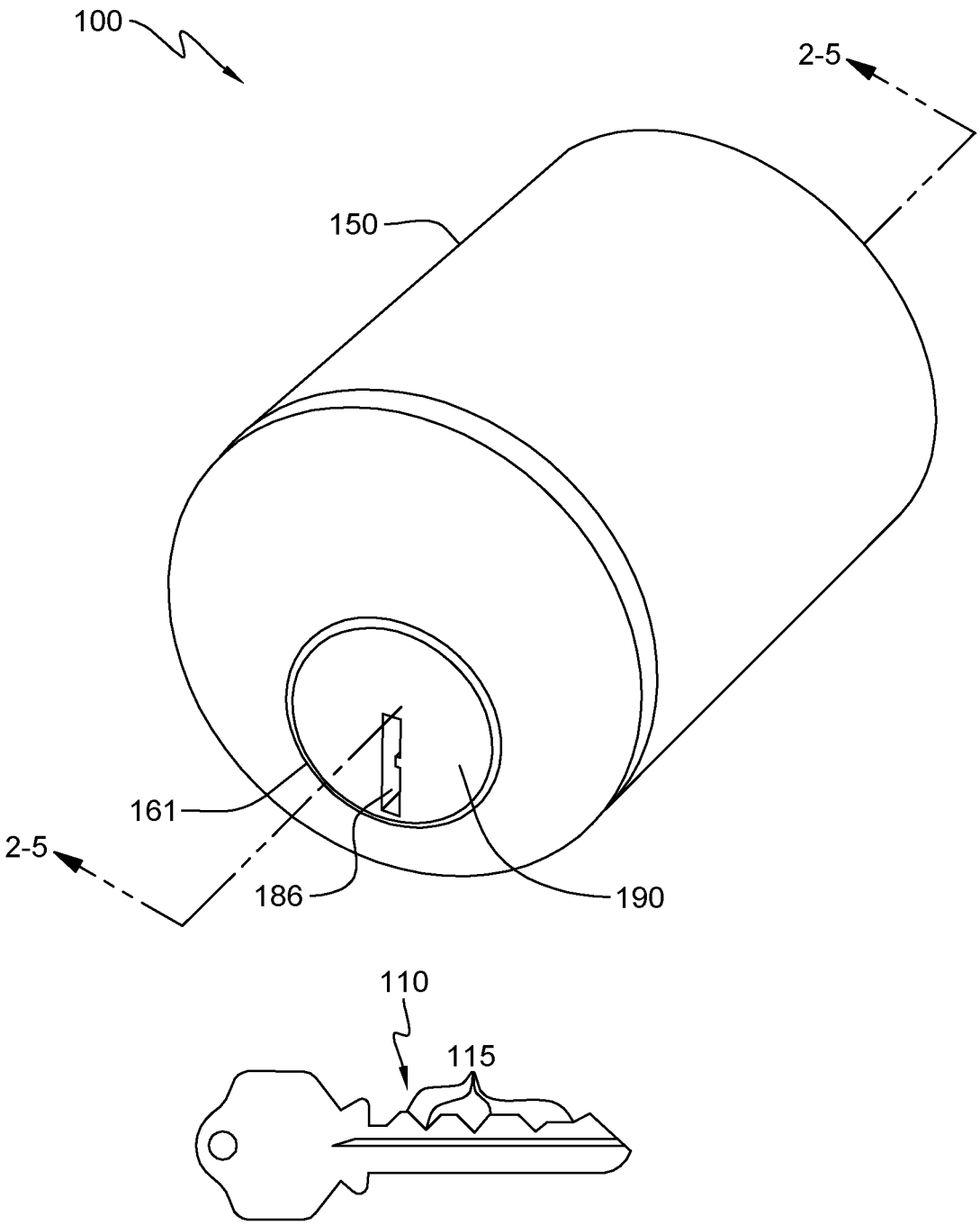
FIG. 1 a diagrammatic illustration of a lock and key system according to illustrative embodiments.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate keys and locks, more particular aspects relate to tamper or pick resistant pin type locks. While the present disclosure is not necessarily limited to such applications, various aspects of the disclosure may be appreciated through a discussion of various examples using this context.

Figure 2:
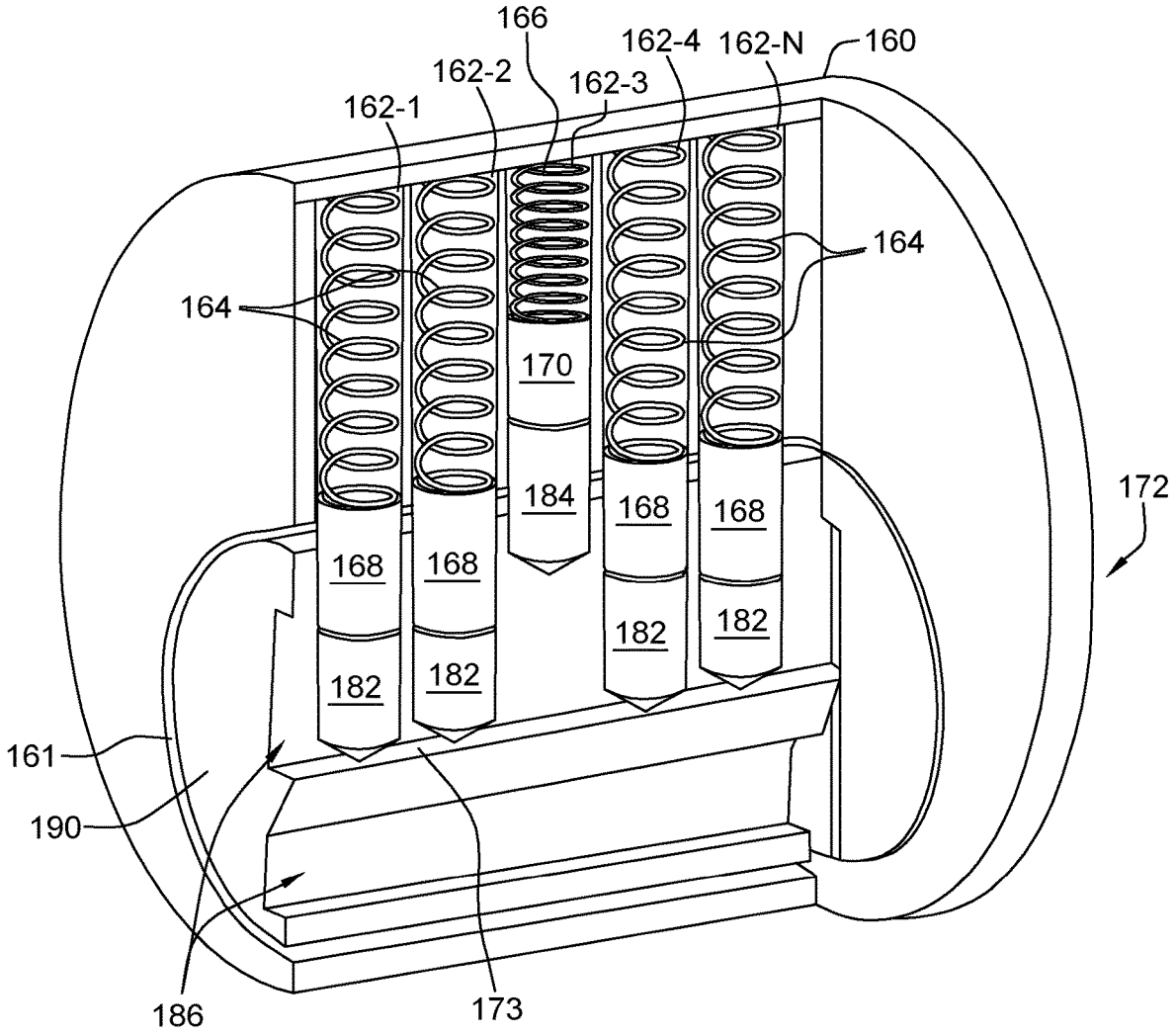
FIG. 2 is a perspective cross section of the lock without a key inserted according to illustrative embodiments.
Figure 3:
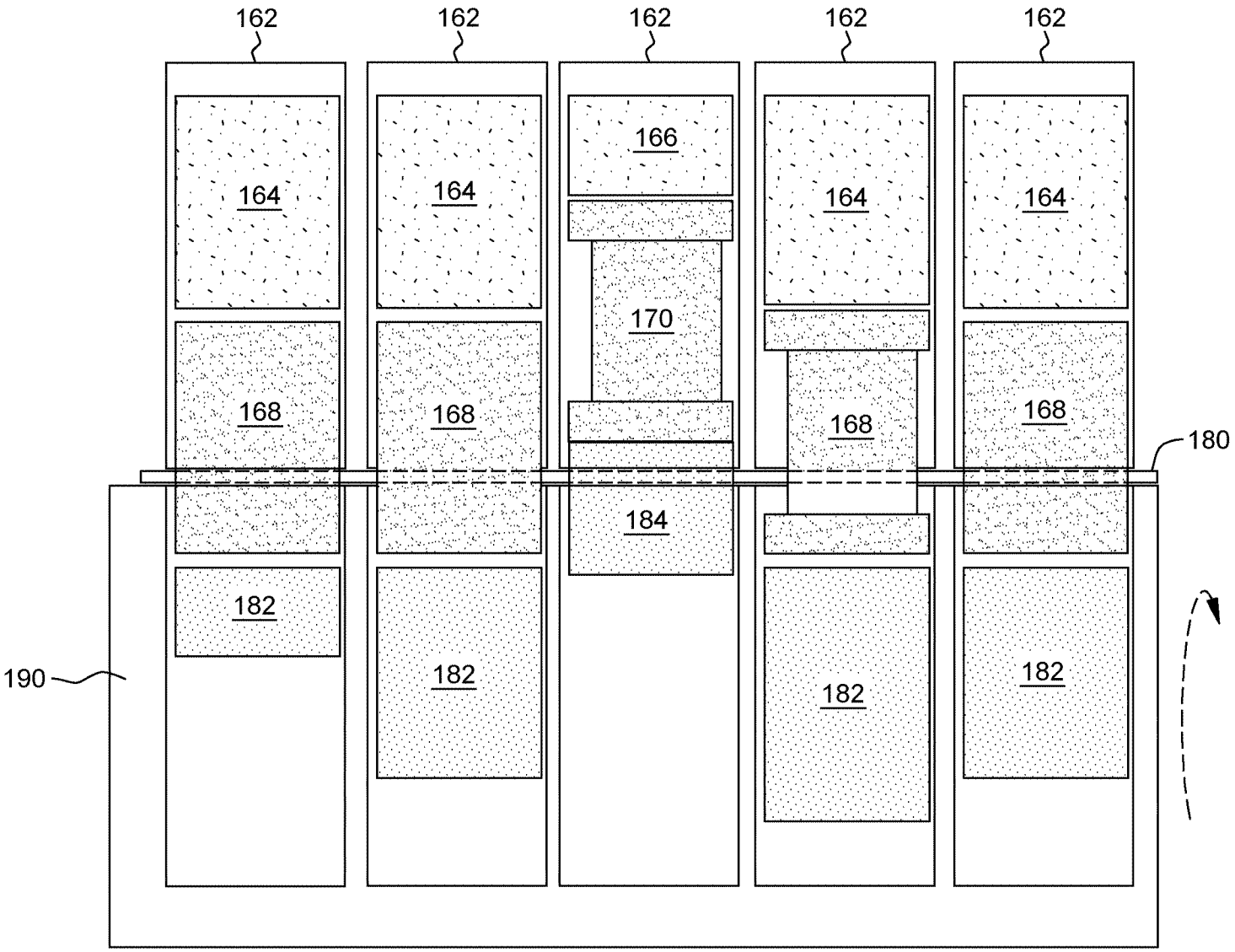
FIG. 3 is a simplified cross section of the lock without the key inserted according to some embodiments.
Figure 4:
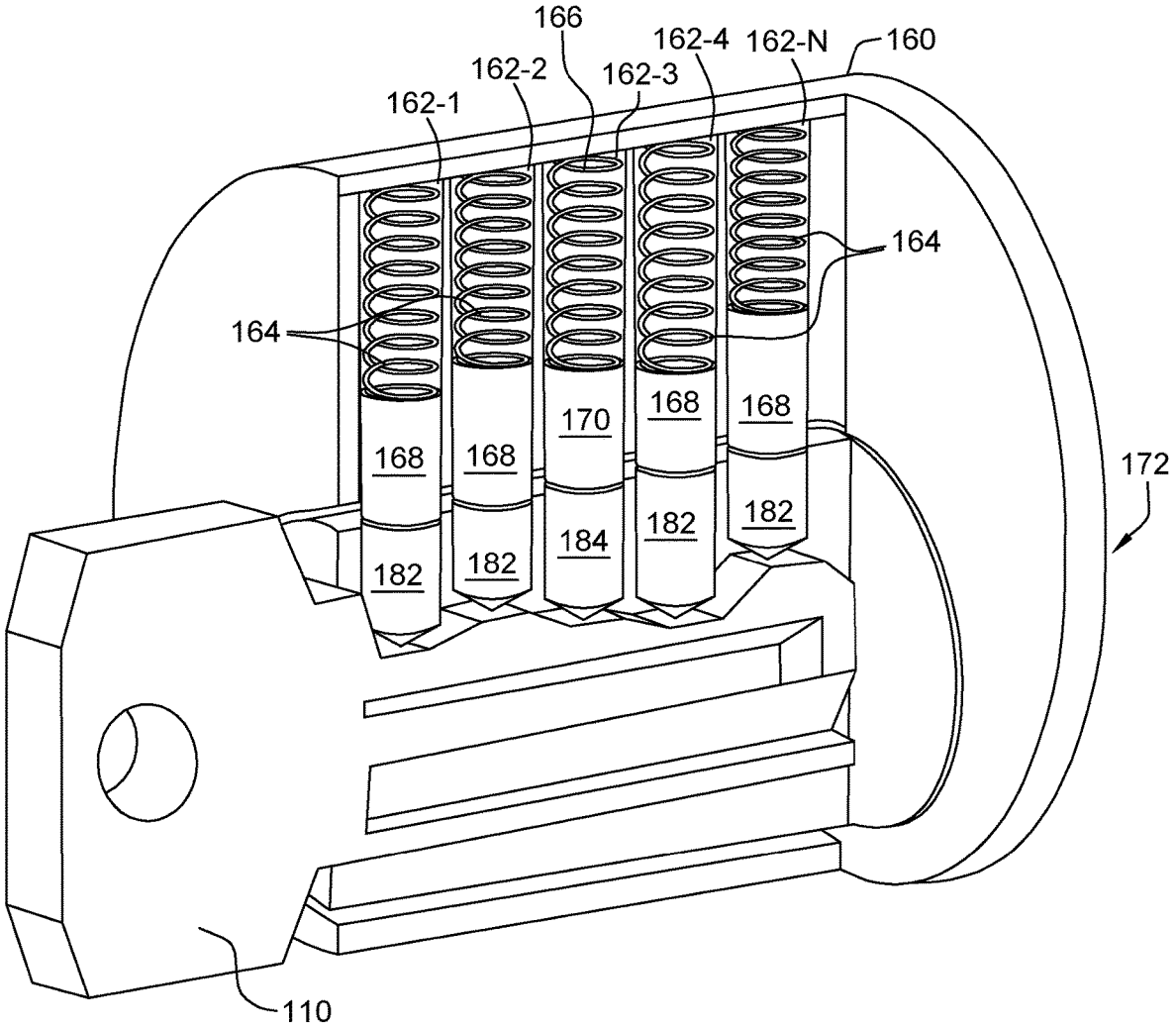
FIG. 4 is an illustrative perspective cross section of the lock with the key inserted according to illustrative embodiments.
Figure 5:
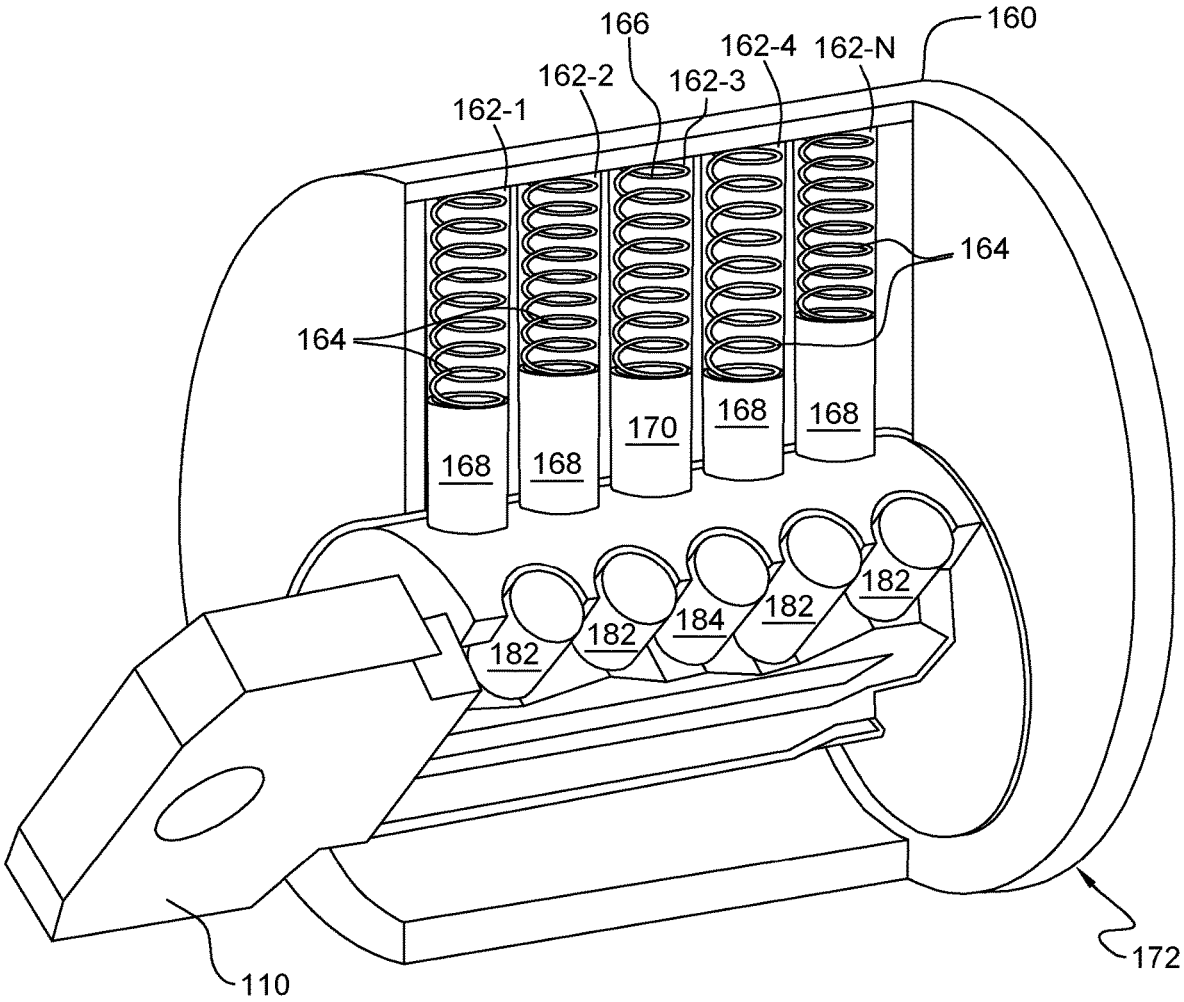
FIG. 5 is a perspective cross section illustrating the lock and key system with the key rotated according to illustrative embodiments.

FIG. 1 is a diagrammatic illustration of a lock and key system 100 according to embodiments of the present disclosure. The lock and key system 100 includes at least one key 110 and a lock 150. FIG. 2 is a perspective cross section of the lock without a key inserted. FIG. 3 is a simplified cross section of the lock 150 without the key inserted. FIG. 4 is a perspective cross section of the lock with the key inserted. FIG. 5 illustrates the lock and key system with the key rotated. FIGS. 1-5 will be discussed together.

Lock 150 is a component of the system 100 that provides the physical protection by securing and unsecuring the item or items locked by the lock. In one embodiment the lock is a pin tumbler lock. However, the lock can be any type of lock that typically has key pins that are moved by springs, such as a wafer tumbler lock or tubular lock. In a pin tumbler lock the lock includes an outer casing 160 and a plug 190. The outer casing 160 has a cylindrical hole 161 in which the plug 190 can be inserted. The outer casing 160 also has a number of vertical shafts 162 that hold the driver pins 168, 170 and the springs 164, 166.

The plug 190 has a keyway 186 at one end and a lever or cam at the other end. The keyway 186 is a straight-shaped slot that allows the key to enter the plug 190. In some embodiments the keyway 186 has protruding ledges that prevent the key pins from falling into the plug 190. The lever and/or cam activates a mechanism that retracts a locking bolt (not illustrated) when the plug 190 is rotated by the key.

The plug 190 also includes a number of holes 162 that contain the key pins 182, 184. The number of holes corresponds to the number of key pins used in the lock. A lock can have any number of key pins 182, 184 present in it. The key pins 182, 184 are of various lengths. The ends of the key pins 182, 184 can be rounded to permit the key to slide more easily past them. Above each key pin 182, 184 is a corresponding driver pin 168, 170. The driver pins 168 are spring loaded by push springs 164. In one embodiment there is only one driver pin for each key pin. However, in other embodiments there are spacer pins (not illustrated) associated with each driver pin. The spacer pins are present in systems where the lock allows for multiple different keys to open the lock, such as a master key. The lock 150 can have any number of spacer pins to allow for multiple different keys to open the lock. For example, in an apartment building where the main door can be opened by all of the keys for the building, but each apartment has its own key. In some embodiments, to further enhance the security of the lock one or more of the holes may not have an associated key pin with it. In some embodiments the hole may have a driver pin without a key pin.

The key pins present in the system 100 include at least one magnetic key pin 184. The magnetic key pin 184 operates differently from the standard key pin/driver pin approach. The magnetic key pin 184 and its corresponding driver pin 170 do not push down into the keyway 186 when a key 110 is not present. In contrast, the associated spring 166 acts to pull the magnetic key pin away from the keyway 186 when the key 110 is not present, and may be referred to as a pull spring. When the key 110 is present the magnetic key pin 184 is attracted to the key 110 such that the magnetic key pin 184 contacts the key 110 at the appropriate point on the key. The connection between the magnetic key pin 184 and the corresponding driver pin 170 can also be achieved through magnetic attraction. In some embodiments the magnetic key pin 184 is a permanent magnet. However, in other embodiments a permanent magnet is attached to one or both ends of the magnetic key pin 184, and the remainder of the key pin is made of another material. In some embodiments the entire key pin 184 is a magnet. The pull spring 166 associated with the magnetic key pin 184 is sized such that it can pull the driver pin/key pin to a point where the magnetic key pin 184 is partially blocking the shear point 180, but not so strong that it can overcome the attractive force between the magnetic key pin 184 and the key 110.

When the plug 190 and outer casing 160 are assembled (and a key is not inserted), the key pins 182 and the driver pins 168 are pushed down into the plug 190 by the springs 164. However, the magnetic key pin 184 is not pushed down into the plug 190, but is kept in place by spring 166. The point where the plug 190 and cylinder meet is called the shear point or shear line 180. When a properly cut key 110 is inserted into the keyway 186 the key pins 182 will rise causing the point between the driver pin 168 and the key 110 to align exactly at the shear point 110. The magnetic key pin 184 is at this point attracted to the key 110 such that the point between the driver pin 170 and the magnetic pin 184 also align with the shear point 180. This allows the plug 190 to rotate, thus opening the lock 150. In embodiments where there are spacer pins, the lock 150 may have a number of shear points that correspond to the keys that are permitted to open the lock. When the key 110 is not in the lock, the driver pins 168 associated with the push springs 164, and the magnetic key pins 184 straddle the shear point 180, preventing the plug 190 from rotating.

The key 110 is a component of the system 100 that is configured to permit and/or cause the lock 150 to rotate, and unlock the lock 150 such that a person or other user can access an area that is locked by the lock. In some embodiments the key 110 is pin tumbler lock key. The pin tumble lock key is commonly found on homes. In some embodiments, the key 110 includes series of grooves on either side of the key that limits the type of lock the key can slide into. As the key slides into the lock, the grooves on the blade of the key align with the wards in the keyway 186 allowing or denying entry to the cylinder. Then a series of bittings 115 (e.g., pointed teeth and notches) on the blade allow pins or wafers to move up and down until they align with the shear line of the inner and outer cylinder. The key is made of a ferromagnetic material. For example, the key can be made of iron, steel (such as KS steel, MKM steel, etc), cobalt, nickel, or any other material to which a magnet is attracted. To the observer of the key there is nothing different with the key that identifies the key as being different from other keys used with a pin tumbler lock. Presuming the correct key is inserted, the key is rotated in the lock allowing the cylinder or cam to rotate freely inside the lock, which opens the lock. In some embodiments, the key 110 is only ferromagnetic in the portions of the blade where the magnetic key pin 184 would contact the key. This embodiment allows for the key to be made primarily of a different substance, such as plastic, to reduce the overall cost of the key or to permit the key to be customized for the system (such as having a picture or other design on the key).

Figure 6:
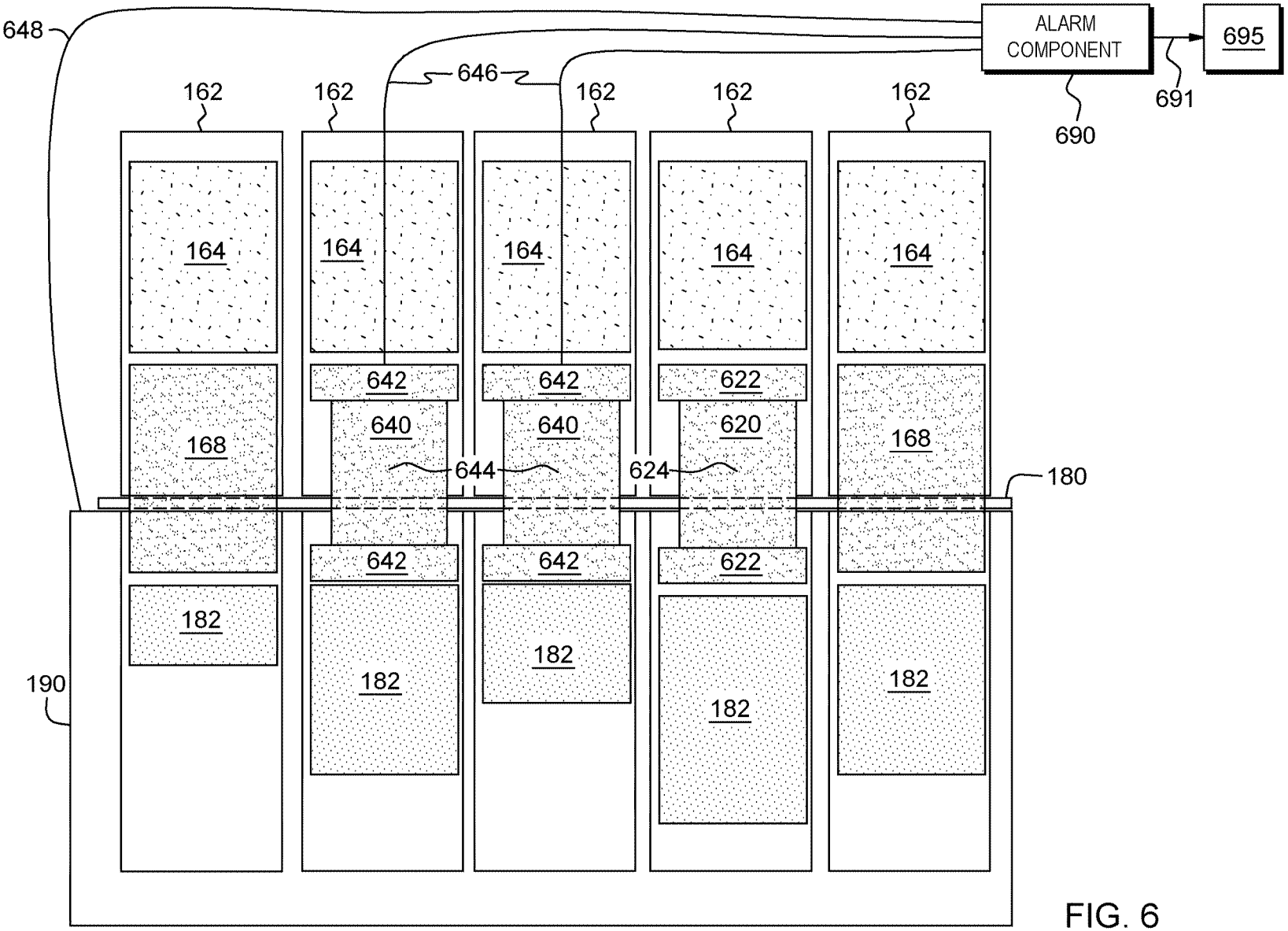
FIG. 6 is a simplified cross section of the lock and key system configured to provide an alert when the lock is tampered with according to illustrative embodiments.

FIG. 6 is a cross section of the lock and key system 100 of FIG. 1 according to one illustrative embodiment where the lock is configured to provide an alert when the lock is tampered with. Tampering could be indicative of a person attempting to pick the lock to gain unauthorized access. FIG. 6 illustrates a plurality of holes 162, plurality of springs 164, a plurality of driver pins 168, 620, 640, and a plurality of key pins 182. For purposes of this discussion components illustrated in FIG. 6 that were discussed above with respect to FIGS. 1-5 will not be discussed in further detail, and are referred to with corresponding reference numbers. The embodiments illustrated in FIG. 6 can be used alone or in conjunction with the features of the embodiments discussed above with respect to FIGS. 2-5.

The driver pins 168, 620, 640 of the lock 150 are divided into at least two different types of driver pins. The first type of driver pins are traditional driver pins 168. These driver pins 168 occupy the full space of the corresponding hole 162 for which they are associated with. The second type of driver pins are security driver pins 620, 640. The lock 150 according to the embodiments of FIG. 6 has at least one enhanced security pin 640. The lock 150 is not required to have a traditional pin 168. However, it may be preferable to have at least one traditional pin to prevent false positives, by preventing the plug 190 from rotating if the traditional driver pin 168 crosses the shear line 180. Illustrated in FIG. 6 are traditional pins 168, security pin 620 and enhanced security pins 640.

A security pin is a modified version of the driver pin that makes manipulation more difficult. Security pins are commonly designed to prevent lock picking, but are also designed to resist decoding, impressioning, key bumping, and other compromise techniques. Security pins are designed so that use of a tool other than a key will trigger the pins, and lock one or more pins at the shear line. This can be due to individual manipulation of components or tension on the plug 190. When triggered, security pins bind between the plug 190 and cylinder, blocking the rotation of the plug 190 until tension on the plug 190 is released and pins are dropped back to their resting position. The security pin can be a mushroom, a spool, a serrated, or hybrid pin. A mushroom security pin is a security pin with a beveled cut around its circumference, resembling a mushroom shape. In a spool security pin a portion of the center removed, resembling a spool or barbell shape. A serrated security pin has light serrations around the circumference of the pin. A hybrid security pin has features that combine the features of the mushroom, spool, and/or serrated security pins.

Illustrated in FIG. 6 the security pins 620 and 640 are spool type security pins. In this embodiment, the top and bottom portions 622, 642 of the pin 620, 640 are circular in shape corresponding to the shape of the corresponding hole 162. Disposed between the top and bottom portions 622, 642 is a center portion 624, 644 that has a diameter that is smaller than the diameter of the top and bottom portions 622, 642. However, as discussed above the security pins 620, 640 can be any type of security pin. In some embodiments each of the security pins can implement a different type of security pin.

To enable the detection of an attempt to breach the lock, at least one of the enhanced security pins is modified to react, electrically, when the lock picker manipulates the pin. Illustrated in FIG. 6 are two enhanced security pins 640. The enhanced security pins replace the top and bottom portions 642 of a standard spool security pin with a non conductive material. The center portion 644 is made of an electrically conducive material. Disposed into the enhanced security pin is a wire 646 providing a conductive charge to the center potion 644. Connected to either the plug 190 or the outer casing 160 is a second wire 648.

The wire 646 and the second wire 648 connect to an alert component 690 disposed away from the lock 150. The location of the alert component 690 can be anywhere the user of the lock wishes to have it. However, in some embodiments the alert component 690 can be part of the lock 150. Additional the alert component 690 can be further connected to other systems 695 that permit a notification of the attempted breach to be received. For example, the alert component 690 may connect to an alarm, a siren, a light, a computer system, a camera, etc. Further, the alert component 690 can be, in some embodiments, connected to two or more devices or alarms.

Figure 7:
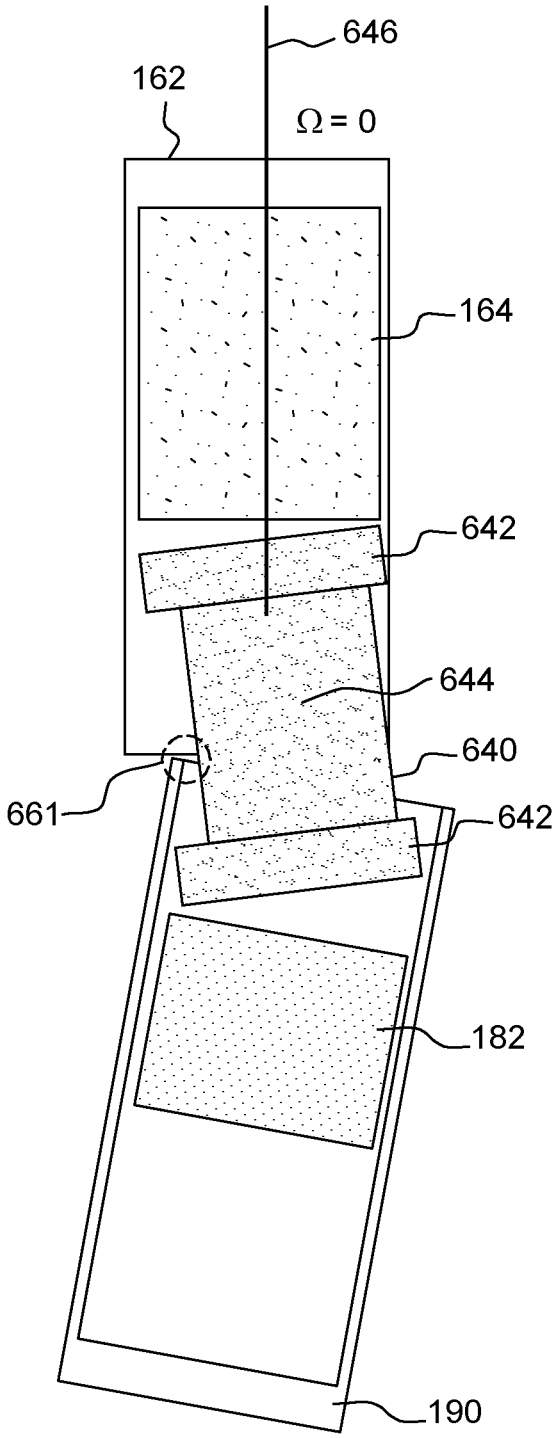
FIG. 7 is a simplified cross section of an enhanced security pin engaging when tampered with according to illustrative embodiments.

When the lock 150 is opened by inserting a correct key and then turning the plug 190 the center portion 644 of the spool pins (enhanced security pins) will not make contact with anything and remain electrically isolated. However, when the lock is attempted to be forced open the plug 190 will be turned before the pins are aligned and the center of the spool 644 will make contact with the a portion 660, 661 of the corresponding pin hole (either in the plug 190 or the outer casing 160). This causes a circuit between the lock 150 and the alert component 690 to close, and create an electrical signal. This is illustrated in FIG. 7. The electrical signal when received by the alert component 690 causes the alert component to generate an alert signal 691. The alert signal 691 is then sent to the system 695 that in turn cause the alert or alarm to be realized. In some embodiments the system 695 is a component of the alert component 690.

In some embodiments, to prevent false positives at least one of the driver pins is a traditional driver pin 168. The traditional pin 168 will prevent the plug 190 from turning until it has been aligned with the shear line 180. Once a traditional pin 168 has been manipulated (in a picking attempt) to the shear line 180 the lock will get extra loose, and the additional play will allow the enhanced security pins 640 to make contact. When the enhanced security pins are tripped, a security action can be executed based on the alert signal from the alarm component such as triggering an alarm, jamming the lock, etc.

In summary, according to embodiments of the present disclosure a lock comprising a plug and an outer casing is disclosed. The plug has a keyway and a first plurality of shafts. The outer casing has a plug hole disposed in a center portion of the outer casing. The plug hole is shaped to accept the plug into the outer casing. The outer casing further includes a second plurality of shafts. A plurality of springs is disposed within the second plurality of shafts, each of the second plurality of shafts has a single spring. A plurality of driver pins are connected to a corresponding one of the plurality of springs. A plurality of key pins are connected to a corresponding one of the plurality of driver pins. At least one of the driver pins is an enhanced security pin. The enhanced security pin has a top portion and a bottom portion comprised of a non-conductive material and a center portion comprised of an electrically conductive material. A wire is disposed in the center portion of the security pin and a second wire is disposed in either the plug or the outer casing. An alert component is connected to both of the wires such that when the center portion contacts a portion of either the plug or the outer casing an electrical circuit is completed between the first wire, the second wire and the alert component causing the alert component to generate an alert signal.

According to embodiments of the present disclosure a method of detecting an attempted tampering with a lock is disclosed. The method begins by inserting a tool other than a key into a keyway of the lock. Next a plurality of key pins and a plurality of driver pins within the lock are displaced by the tool. At least one of the plurality of driver pins is an enhanced security pin. Next the plug of the lock is rotated, however, full rotation of the plug is prevented by the enhanced security pin contacting a portion of the plug or a portion of an outer casing of the lock. This occurs because the enhanced security pin does not align with the shear line. This completes a circuit between the enhanced security pin and an alert component. As a result of the completed circuit the alert component generates an alert.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A lock comprising:

a plug, the plug having a keyway and a first plurality of shafts;

an outer casing, the outer casing having a plug hole disposed in a center portion of the outer casing, the plug hole shaped to accept the plug into the outer casing, the outer casing further including a second plurality of shafts;

a plurality of springs disposed within the second plurality of shafts, each of the second plurality of shafts having a single spring;

a plurality of driver pins connected to a corresponding one of the plurality of springs, wherein at least two of the plurality of driver pins are an enhanced security pins, at least one of the enhanced security pins is a hybrid security pin, wherein the hybrid security pin incorporates features from two or more types of security pins having a top portion and a bottom portion comprised of a non-conductive material and a center portion comprised of an electrically conductive material, wherein the top portion and the bottom portion are of equal diameter and the center portion has bevel cut around a circumference between the top portion and the bottom portion, and at least one of the enhanced security pins is a spool security pin wherein the top portion and the bottom portion are of equal size and the center portion has a diameter smaller than the diameter of the top portion and the bottom portion;

a plurality of key pins connected to a corresponding one of the plurality of driver pins; and a first wire disposed within the enhanced security pin;

a second wire disposed within the plug;

an alert component connected to the first wire and the second wire such that when the center portion contacts a portion of either the plug or the outer casing an electrical circuit is completed between the first wire, the second wire and the alert component causing the alert component to generate an alert signal.

2. The lock of claim 1 wherein the enhanced security pin is a mushroom security pin, wherein the top portion and the bottom portion are of equal diameter and the center portion has a diameter that progressively decreases from the top portion to the bottom portion.

3. The lock of claim 1 wherein the enhanced security pin is a mushroom security pin, wherein the top portion and the bottom portion are of equal diameter and the center portion has a diameter that progressively decreases from the bottom portion to the top portion.

4. The lock of claim 1 wherein at least one of the plurality of driver pins is a security pin.

5. The lock of claim 1 wherein at least one of the plurality of driver pins is a traditional driver pin.

6. The lock of claim 1 wherein at least one of the plurality of driver pins is a security pin, and at least one of the driver pins is a traditional driver pin.

7. The lock of claim 1 wherein at least one of the plurality of key pins is a magnetic key pin, and wherein a spring associated with the magnetic key pin is a pull spring.

8. The lock of claim 7 wherein the magnetic key pin is comprised of a magnet.

9. The lock of claim 7 wherein the magnetic key pin blocks a shear line between the plug and the outer casing when a key is not inserted.

10. The lock of claim 7 wherein a plurality of the key pins are magnetic key pins and at least one of the plurality of key pins is not a magnetic key pin.

11. The lock of claim 1 wherein the alert signal causes a visual indication to be generated.

12. The lock of claim 11 wherein the alert signal is generated when the lock has been tampered.

* * * * *